US005888326A

United States Patent [19]

Shillan et al.

[11] Patent Number: 5,888,326

[45] Date of Patent: Mar. 30, 1999

[54] METHOD FOR REPRODUCING A PHOTOGRAPHIC IMAGE DIRECTLY ONTO A METAL SURFACE

[76] Inventors: Michael David Shillan, 22482 Calapatria Dr., Calabasas, Calif. 91302; Alan Zoltie, 3 Kendrick Mews, London, England, SW7 3HG

[21] Appl. No.: 963,439

[22] Filed: Nov. 3, 1997

Related U.S. Application Data

[62] Division of Ser. No. 192,546, Feb. 7, 1994, Pat. No. 5,683, 763.

[51] Int. Cl.[6] ..... B44C 5/02; G09F 7/06

[52] U.S. Cl. ..... 156/59; 156/233; 430/323

[58] Field of Search ..... 428/13, 28, 542.8, 428/195; 156/59, 233; 430/323

[56] References Cited

U.S. PATENT DOCUMENTS

| | | | |
|---|---|---|---|
| 2,145,071 | 1/1939 | Cave | 428/28 X |
| 3,537,958 | 11/1970 | Wrenn et al. | 430/323 X |
| 4,254,544 | 3/1981 | Barker | 428/195 X |
| 5,339,731 | 8/1994 | Howard et al. | 428/542.8 X |
| 5,683,763 | 11/1997 | Shillan et al. | 428/13 |

*Primary Examiner*—Henry F. Epstein

*Attorney, Agent, or Firm*—Lewis Anten, Esq.; Amedeo Ferraro, Esq.

[57] ABSTRACT

A decorative pin having a surface made of metal for displaying a high quality color photographic image having a high degree of image resolution reproduced directly onto a metal surface and a method for reproducing a high quality photographic image directly onto a metal surface are disclosed. The decorative pin of the present invention comprises a base member made of brass having an upper surface for displaying a photographic image that is reproduced directly onto the upper surface and a lower surface having means for removably attaching the decorative pin to a garment.

6 Claims, 3 Drawing Sheets

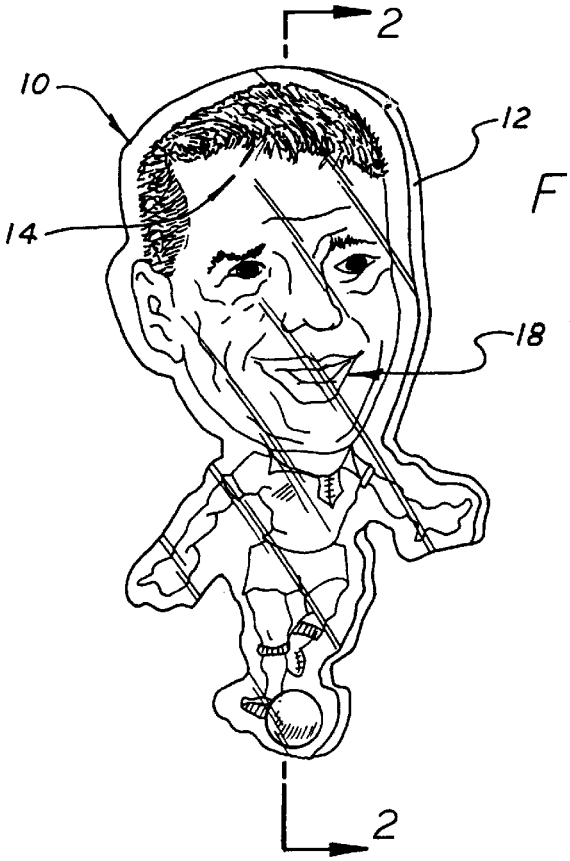
FIG. 1
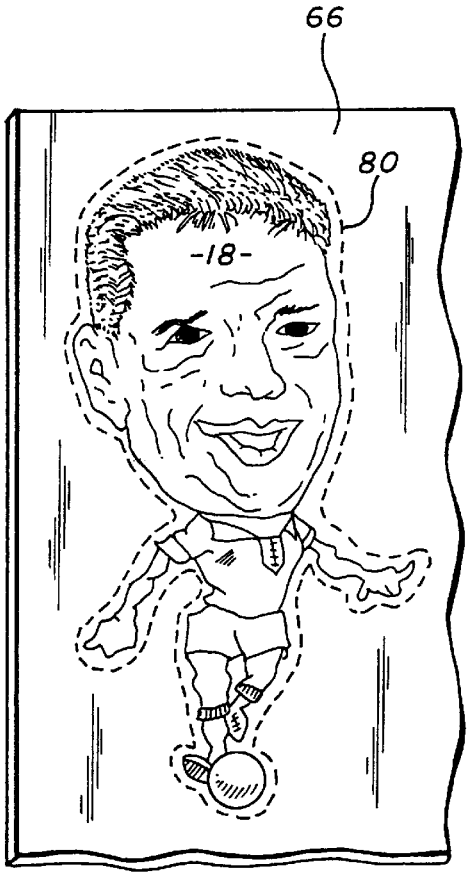
FIG. 5
FIG. 2
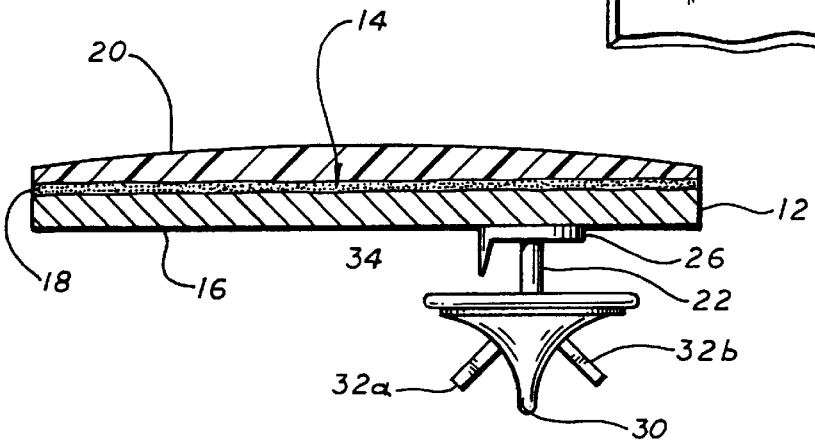

50
52
54
56
58
60
62
64
65
66
68a
70a
18

METHOD FOR REPRODUCING A PHOTOGRAPHIC IMAGE DIRECTLY ONTO A METAL SURFACE

This application is a division of application Ser. No. 08/192,546, filed on Feb. 7, 1994 and now U.S. Pat. No. 5,683,763.

BACKGROUND OF THE INVENTION

1. Field of the Invention

This invention relates to metal decorative pins having a photographic image reproduced directly onto a surface of the metal pin and a method for reproducing the color photographic image directly onto a metal surface.

2. Description of the Related Art

Decorative pins and buttons displaying names, logos, symbols and images of products are an interesting part of popular culture in many countries and have been worn and collected by people for decades. In the past it has been popular to collect an assortment of decorative pins displaying a variety of images ranging from anti-war slogans to diagrammatic images of rock stars.

However, the decorative pins of the past, especially those made of metal, were limited in that there was no known process for reproducing a high-quality photographic image having a high degree of image resolution directly onto the surface of the metal used to make the pin. Instead, a photographic image was first printed onto a piece of paper or similar porous material which was subsequently laminated onto the metal surface with an adhesive material. As a result, there was a detectable border from the paper underlying the image surrounding the perimeter of the photographic image which detracted from the aesthetic appeal of the ultimate product. Moreover, because the image was first printed onto paper, even if photography paper was used, the resolution of the image was not as high as that of an image which is printed directly onto a metal surface.

Therefore, there exists a need for a method for producing a high quality photographic image directly onto the surface of a metal pin that is inexpensive and easy to manufacture.

SUMMARY OF THE INVENTION

The present invention discloses a decorative pin having a surface made of metal for displaying a high quality color photographic image having a high degree of image resolution that is reproduced directly onto that metal surface and the method for reproducing a high quality photographic image directly onto the metal surface. In the preferred embodiment, the decorative pin of the present invention comprises a base member made of brass having an upper surface for displaying a photographic image that is reproduced directly onto that upper surface by the printing process of the present invention.

The printing process of the present invention includes the steps of separating the colors of a photographic image that is desired to be reproduced into four basic colors and into the appropriate number of half-tone colors; making a plurality of photographic film sheets each having a color specific or half-tone color specific negative image of the photographic image, such that one color specific negative image is created for each of the four basic colors and for each of the half-tone colors; etching an imprint of each color specific negative image and half-tone color specific negative image onto a separate printing plate, such that a separate printing plate is made for each of the four basic colors and for each of the half-tone colors; applying paint to each of the printing plates with a metal decorating printing machine; transferring a paint imprint from the printing plate directly to the metal surface of a sheet of metal to create a reproduction of a photographic image; and drying the painted imprint.

These steps are repeated for each of the colors, allowing each color to dry before the application of the next. After the last color is dried, the reproduced photographic image is cut from the sheet of metal, and a transparent protective means such as epoxy or a poly resin material is then placed over the reproduced image to protect it from being damaged. In the preferred embodiment, reference marks are also printed onto the metal sheet surrounding the perimeter of the reproduced image and are used as a guide so that each image may be cut from the sheet of metal along the perimeter of each of the images in the shape of the image that is being reproduced.

As it may be desired to print more than one image at a time onto a sheet of metal, each photographic film sheet may comprise a series of the same color specific negative of the image desired to be reproduced so that printing plates may be etched having a series of imprints of the color specific negative and may be used to print a plurality of reproduced photographic images onto a sheet of metal. Each of the printing plates is made in a conventional manner that is well-known to those skilled in the art such as, but not limited to, photo-etching.

The metal decorating printing machine has a plurality of rollers that apply a particular color of paint corresponding to the basic color or half-tone color for which the imprint of the color specific or half-tone color specific negative image on a particular printing plate has been made. One of the rollers of the metal decorating printing machine is a plate cylinder which rolls over the printing plates and transfers an imprint of the negative images onto a sheet of metal and thus creates an image on the sheet of metal.

OBJECTS OF THE PRESENT INVENTION

It is an object of the present invention to provide a decorative pin with a displaying area made of metal on which a color photographic image is reproduced.

It is another object of the present invention to provide a method for reproducing a photographic image of high quality and clear image resolution directly onto a metal surface.

It is a further object of the present invention to provide a decorative pin having a metal displaying area with a photographic image of the face of a person or a photographic image of a product reproduced directly onto the metal displaying area.

It is yet another object of the present invention to provide a decorative pin having a metal displaying area on which a photographic image is reproduced that is inexpensive and easy to manufacture.

It is still a further object of the present invention to provide a decorative pin having a metal displaying area on which a photographic image is reproduced that is of superior quality and of superior image resolution than previously possible.

These and other objects of the present invention will become apparent from a review of the accompanying drawings and the detailed description of the drawings.

BRIEF DESCRIPTION OF THE DRAWINGS

FIG. 1 is a top perspective view of the decorative pin of the present invention having a metal displaying area with a photographic image reproduced directly onto the metal displaying area of the pin.

FIG. 2 is a cross sectional view of the decorative pin of the present invention along line 2—2 of FIG. 1.

FIG. 5 is a top plan view of a portion of a metal sheet having a photographic image reproduced directly onto its surface with the method of the present invention.

DETAILED DESCRIPTION OF THE DRAWINGS

Figure 3:
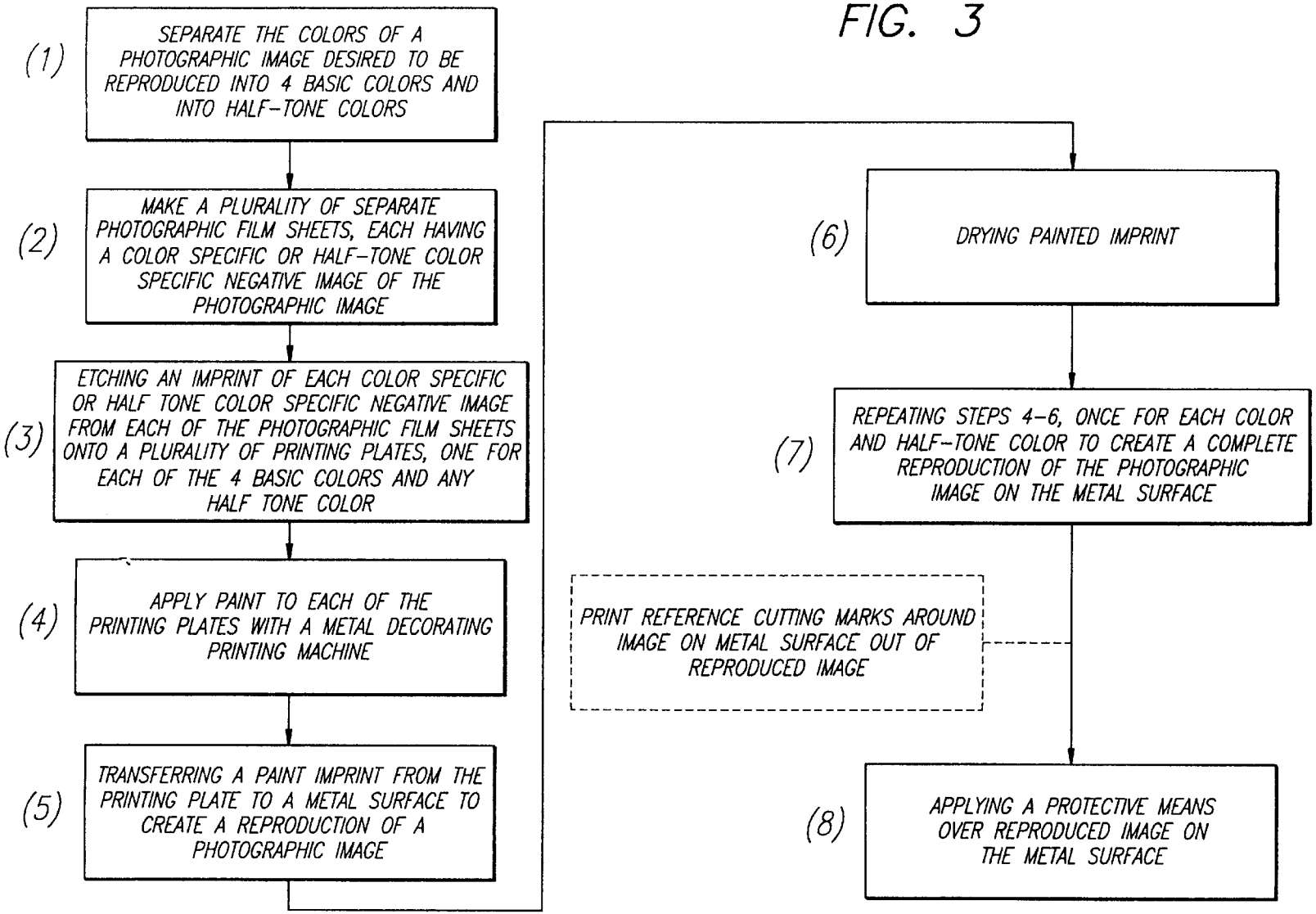
FIG. 3 is a diagrammatic representation of the steps of the method of the present invention used to reproduce a photographic image directly onto a metal surface.

Referring to FIGS. 1–2, the preferred embodiment of the decorative pin of the present invention is generally referred to by the numeral 10. The pin 10 comprises a base member 12 made of metal, having an upper surface 14 and a lower surface 16. The upper surface 14 is a displaying area on which one or more images are directly reproduced. In the preferred embodiment of the pin 10, the upper surface 14 has a photographic image 18 reproduced directly onto the surface of the metal of the pin 10. It is appreciated that the photographic image 18 may be any type of image, such as, but not limited to the image of a person, the image of a product or an image of any other subject and may be in color or in black and white. In the preferred embodiment, the base member 12 has a width of approximately 2.0 mm, a length of approximately 3.5 mm and a thickness of approximately 0.10 mm. However, it is appreciated that many other dimensions are possible as the pin 10 may be manufactured in different sizes.

The photographic image 18 is reproduced directly onto the upper surface 14 by a printing process-described in detail in the description of the method of the present invention set forth below. The reproduction of the photographic image 18 directly onto the metal upper surface 14 results in a high quality image having a higher resolution than an image that is first reproduced onto paper and subsequently adhered to the upper surface 14. The higher quality reproduction of the photographic image 18 is attained as a result of the metal surface being less porous than paper and also because the metal surface can be made smoother than paper by methods well-known to those skilled in the art. In the preferred embodiment of the pin 10, the base member 12 is made of brass, however other types of metal may also be used, such as, but not limited to steel, aluminum and tin. In the preferred embodiment of the pin 10, the base member 12 is cut into a shape that conforms and corresponds to the outline of the photographic image 18 that is printed onto the flat upper surface 14 as shown in FIG. 1.

Referring to FIG. 2, once the photographic image 18 is reproduced on the upper surface 14, the photographic image 18 is covered by a transparent layer 20, which in the preferred embodiment is a layer of epoxy, but may be any other translucent material used for laminating, such as, but not limited to a poly resin material. The transparent layer 20 serves to protect the photographic image 18 from becoming scratched or marred and functions to seal the paint used in reproducing the photographic image 18. In the preferred embodiment, the transparent layer 20 is clear, but it is also appreciated that the transparent layer 20 may be tinted in a number of different colors.

Attached to and depending from the lower surface 16 of the base member 12 is a needle 22 having a flat head portion 26 at one end. The flat head portion 26 is permanently attached to the lower surface 16 of the base member 12 by a suitable adhesive means or by welding, brazing or any other metal fixing means well known by those skilled in the art.

The needle 22 removably engages a clasping member 30 which clasps the needle 22 and functions to secure the decorative pin 10 to a garment once the needle 22 is inserted into a portion of the garment such as the lapel of a jacket or inserted into a hat or cap. The clasping member 30 comprises clamp means 32*a* and 32*b* for removably engaging the needle 22. The clamp means 32*a* and 32*b* of the clasping member 30 engage the needle 22 and prevent the removal of the decorative pin 10 from the garment into which it is inserted.

Extending from the flat head portion 26 is a positioning member 34 that is substantially shorter than the needle 22 and functions to prevent the rotation of the pin 10 once the needle 22 is inserted into a garment.

Referring to FIG. 3, a diagrammatic representation of the steps used in the preferred embodiment of the printing process and method of the present invention for reproducing a color photographic image 18 directly onto a metal surface is shown.

In the method of the present invention, the photographic image 18 that is desired to be reproduced onto a metal surface is first broken up into 140–150 points per square inch through a computer-assisted imaging process well known by those skilled in the art. The colors of the photographic image 18 are separated into four basic colors: blue, yellow, magenta and black; and further separated into the appropriate half-tone colors, such as green (blue-yellow), or orange (yellow-magenta) for example. The percentage of each of the basic colors and each of the half-tone colors is adjusted in order to obtain the proper color combination to accurately reproduce the colors of the photographic image 18. The percentage of each color and half-tone color may be adjusted manually or may be adjusted with computerized equipment well known to those skilled in the art.

Once the percentage of each of the four basic colors and of each of the half-tone colors is determined, a plurality of photographic film sheets are made, each having a color specific or half-tone color specific photographic negative image of the photographic image 18. The photographic film sheets are then used to etch imprints $\mathbf{70}_{a \ldots n}$, one for each color specific negative image and half-tone color specific negative image onto a plurality of printing plates $\mathbf{68}_{a \ldots n}$. Each printing plate $\mathbf{68}_{a \ldots n}$ has an imprint $\mathbf{70}_{a \ldots n}$ etched thereon that corresponds to the color specific or half-tone color specific photographic negative image from the photographic film sheets. Each imprint $\mathbf{70}_{a \ldots n}$ is etched into the surface of the printing plates $\mathbf{68}_{a \ldots n}$ by a photo etching process that is well-known by those skilled in the art. Each of the printing plates $\mathbf{68}_{a \ldots n}$ is then used to apply one of the four basic colors or one of the half-tone colors onto a metal surface, such as a sheet of metal 66, on which the photographic image 18 is desired to be reproduced. Each of the printing plates $\mathbf{68}_{a \ldots n}$ is used with a printing machine 50 such as, but not limited to, a metal decorating automatic printing press, model number 600D331002, available from Koyosha, Mfg. Co., Ltd., Japan, which is capable of printing directly onto sheet metal.

Figure 4:
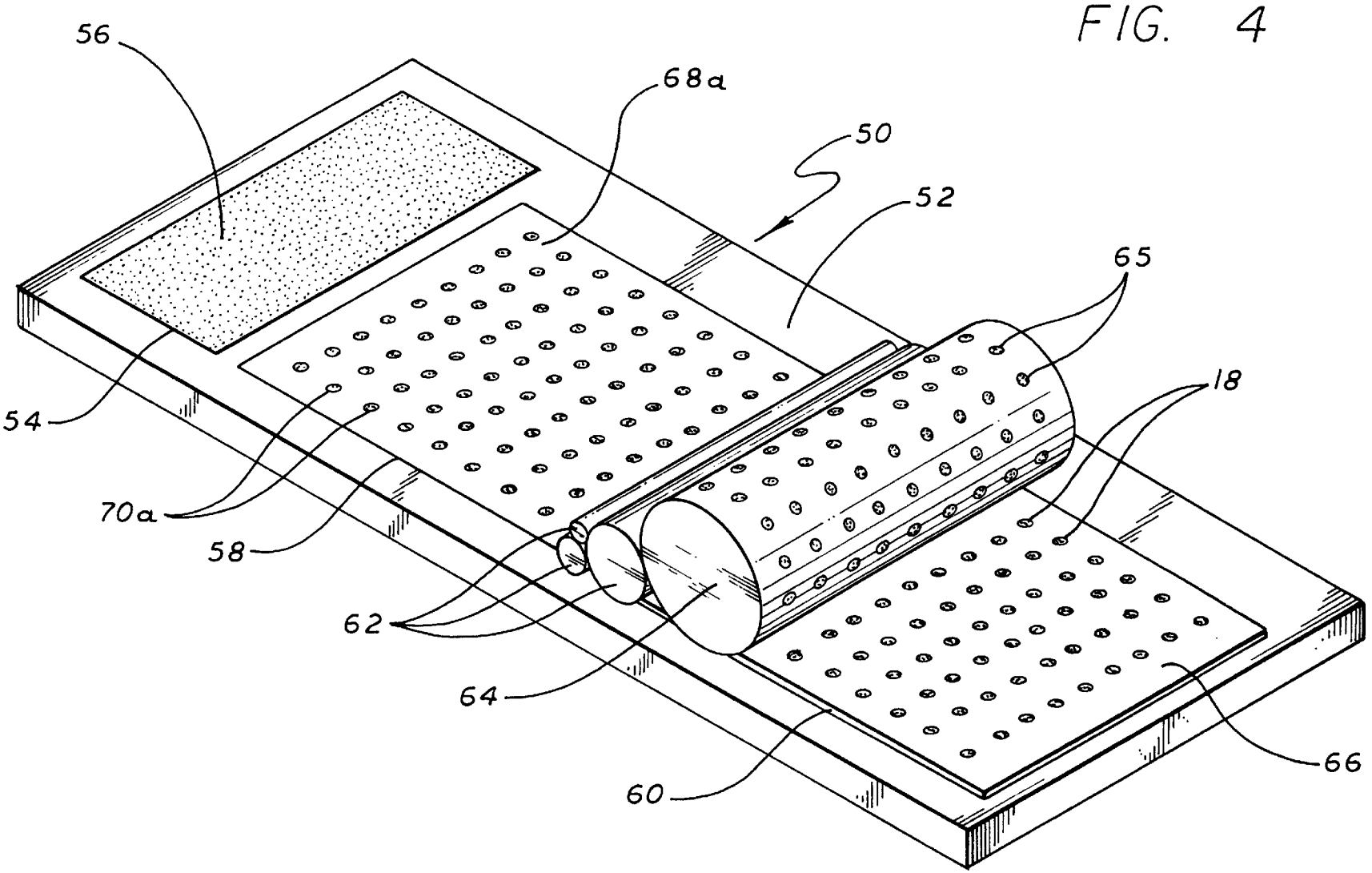
FIG. 4 is a top perspective view of the printing equipment used to reproduce a photographic image directly onto a metal surface with the method of the present invention.

Referring to FIG. 4, a diagrammatic representation of the printing machine 50 used to reproduce a photographic image 18 directly onto a metal surface is shown. The printing machine 50 has an upper surface 52 comprising a well 54 for containing paint 56, a printing plate placement area 58 and a sheet metal placement area 60. Directly above the upper surface 52 are paint rollers 62 and a plate cylinder 64. A sheet of metal 66, preferably brass, approximately 1/16 inches thick is placed onto the sheet metal placement area 60. A printing plate 68*a* having a plurality of etched imprints 70 of a color specific or half-tone color specific photographic image negative image corresponding to one of the four basic colors or one of the half-tone colors described above is placed in the printing plate placement area 58. In the preferred embodiment, the printing plate 68*a* has a plurality of etched imprints 70*a* of the color-specific or half-tone color specific negative image of the photographic image 18 etched onto its surface such that a plurality of prints of the etched imprints $\mathbf{70}_{a \ldots n}$ may be made at one time.

To begin the printing process, the well 54 is filled with the color of paint 56 corresponding to the individual printing plate a 68*a* being made for that particular color. The paint rollers 62 are dipped into the well 56 and are rolled over the printing plate 68*a* to place paint 56 onto the printing plate 68*a*. Once the paint 56 is applied, the plate cylinder 64 rolls over the printing plate 68*a* and a reverse negative print 65 of the etched imprints 70*a* contained on the printing plate 68*a* is made on the surface of the plate cylinder 64. The plate cylinder 64 is subsequently rolled over the sheet of metal 66 such that the reverse negative print 65 of the etched imprints 70*a* contacts the surface of the sheet of metal 66 to form a positive print of the etched imprints 70*a* onto the sheet of metal 66 in the corresponding color of paint 56 for which the printing plate 68*a* was made. This process is repeated for each of the four basic colors and for each of the half-tone colors until a complete reproduction of the photographic image 18 is created on the sheet of metal 66.

Between the application of each color or half-tone color of paint 56, the sheet of metal 66 is placed in a conventional heat dryer for approximately 10 minutes to dry each color of paint 56 before the next color is applied.

In this manner all of the four basic colors and all of the half-tone colors of the photographic image 18 are printed onto the metal surface of the sheet of metal 66. In addition to the photographic image 18, reference marks 80 outlining and designating where the photographic image 18 will be cut from the sheet of metal 66 are printed onto the sheet of metal 66. The reference marks 80 ensure that all of the photographic images 18 are cut out of the sheet of metal 66 in the same position. In the preferred embodiment, paint 56 is an enamel paint however it is appreciated that any other type of paint or coloring means capable of bonding to a metal surface may be used.

Once each of the four basic colors and each of the half-tone colors have been applied to the sheet of metal 66, the sheet of metal 66 is cut into strips containing rows of the reproduced photographic images 18. The strips are then fed into a cutting machine, such as the stamping machine available from Hong YI Machinery Enterprise Co., Ltd., Taiwan and the photographic images 18 are die cut along the reference marks 80 outlining the individual photographic 1B images.

After each of the photographic images 18 are cut from the sheet of metal 66, each pin 10 is placed with the upper surface 14 facing down onto a tray, preferably made of wood, and a drop of glue mixed with tin is placed on the lower surface 16 and the flat head portion 26 of the needle 22 is positioned onto the area of the lower surface 16 containing the glue. The tray containing the pin 10 thereon is placed into an oven and heated at a temperature of 100 to 150 degrees Centigrade for 30 minutes in order to melt the glue and secure the needle 22 to the base member 12.

After the pin 10 is cooled, a transparent layer 20 of epoxy is applied by hand to cover the entire upper surface 16 including the photographic image 18 and is left to air dry.

While the present invention has been described in detail with regards to the preferred embodiment, it is appreciated that other variations of the present invention may be devised which do not depart form the inventive concept of the present invention.

For example, the method of the present invention for reproducing a photographic image onto a metal surface is not limited to brass and may be adapted to providing photographic images onto other metals such as, but not limited to steel, aluminum or tin without departing from the scope of the present invention. In addition, although a decorative pin is disclosed as the preferred embodiment, a photographic image may be reproduced onto any metal surface of any decorative item such as, but not limited to, name plates used for product identification indicia, badges, backgrounds for watches, and belt buckles.

What is claimed is:

1. A method for reproducing a photographic image directly onto a metal surface of a sheet of metal, the method comprising the steps of:

(a) separating the colors of a photographic image desired to be reproduced into four basic colors and into a plurality of half-tone colors;

(b) making a separate photographic film sheet with a color specific or half-tone color specific negative of said photographic image for each of said four basic colors and each of said plurality of half-tone colors;

(c) etching an etched imprint of said color specific or half-tone color specific negative of said photographic image onto a plurality of printing plates for each of said basic colors and for each of said plurality of half-tone colors;

(d) applying paint to each of said plurality of printing plates;

(e) transferring a paint imprint of said etched imprint from said plurality of printing plates to said metal surface to create a partial reproduction of said photographic image onto said metal surface;

(f) drying said paint imprint; and (g) repeating steps (d) through (f) for each of said four basic colors and for each of said plurality of half-tone colors to form a complete reproduction of said photographic image on said metal surface, said reproduction of said photographic image comprising a plurality of color layers applied directly onto said metal surface, said plurality of color layers corresponding to the original color tones of said photographic image and preserving the original color tones of said photographic image.

2. The method of claim 1 further comprising the step of printing reference cutting marks onto said metal surface, said reference cutting marks surrounding the perimeter of said complete reproduction of said photographic image and functioning to guide the cutting of said complete reproduction of said photographic image from said sheet of metal.

3. The method of claim 1 further comprising the step of cutting said complete reproduction of said photographic image from said sheet of metal.

4. The method of claim 3 in which the cutting step includes cutting said complete reproduction of said photographic image in the shape of said photographic image.

5. The method of claim 1 further comprising the step of applying a protective layer over said complete reproduction of said photographic image, said protective means preventing the scratching and marring of said complete reproduction of said photographic image.

6. The method of claim 5 in which said protective layer is transparent.

* * * * *